US006164580A

United States Patent [19]

Tholander et al.

[11] Patent Number: 6,164,580

[45] Date of Patent: Dec. 26, 2000

[54] YARN FEEDING DEVICE HAVING A YARN BRAKE THAT IS SELF-CENTERING VIA A U-JOINT

[75] Inventors: Lars Helge Gottfrid Tholander, Ulricehamn; Per Ohlson, Tvaerred, both of Sweden

[73] Assignee: IRO AB, Ulricehamn, Sweden

[21] Appl. No.: 09/319,053

[22] PCT Filed: Nov. 27, 1997

[86] PCT No.: PCT/EP97/06629

§ 371 Date: Aug. 16, 1999

§ 102(e) Date: Aug. 16, 1999

[87] PCT Pub. No.: WO98/23520

PCT Pub. Date: Jun. 4, 1998

[30] Foreign Application Priority Data

Nov. 27, 1997 [DE] Germany ..... 196 49 220

[51] Int. Cl.[7] ..... B65H 51/20

[52] U.S. Cl. ..... 242/365.4; 139/452

[58] Field of Search ..... 242/365.4, 365.1, 242/365.2, 365.5, 364.6; 139/452

[56] References Cited

U.S. PATENT DOCUMENTS

| | | | |
|---|---|---|---|
| 3,982,568 | 9/1976 | Riha et al. | 139/452 |
| 4,429,723 | 2/1984 | Maroino | 139/452 |
| 5,316,051 | 5/1994 | Zenoni et al. . | |
| 5,409,043 | 4/1995 | Zenoni et al. | 242/365.4 X |
| 5,441,087 | 8/1995 | Alberyd et al. | 139/452 |
| 5,487,415 | 1/1996 | Maina | 139/452 |
| 5,489,068 | 2/1996 | Vichiani | 139/452 X |
| 5,553,641 | 9/1996 | Zenoni | 242/365.4 X |
| 5,647,404 | 7/1997 | Maina et al. | 139/452 |
| 5,738,291 | 4/1998 | Tholander . | |

FOREIGN PATENT DOCUMENTS

| | | |
|---|---|---|
| 44 07 958 A1 | 9/1995 | Germany . |
| 9406102 U1 | 9/1995 | Germany . |
| 195 42 045A1 | 5/1997 | Germany . |
| WO 95/00431 | 1/1995 | WIPO . |
| WO 95/28348 | 10/1995 | WIPO . |

*Primary Examiner*—Donald P. Walsh
*Assistant Examiner*—Collin A Webb
*Attorney, Agent, or Firm*—Flynn, Thiel, Boutell & Tanis, P.C.

[57] ABSTRACT

A yarn feeding device having a yarn brake including a wear-proof, radially deformable and frustoconical braking band supported in a braking band carrier. The carrier is held substantially coaxially relative to the axis of a storage body of the yarn feeding device and against a circumferentially continuous withdrawal rim of the storage body. A stationary support and a spring assembly are provided, which spring assembly imparts an essentially axial pre-loading force onto the braking band carrier. The braking band carrier is centered in an axially displaceable fashion at the support by means of a universal joint having at least two mechanically and positively cooperating joint elements. The joint center of the universal joint coincides with the axis of the storage body.

24 Claims, 3 Drawing Sheets

YARN FEEDING DEVICE HAVING A YARN BRAKE THAT IS SELF-CENTERING VIA A U-JOINT

The invention relates to a yarn feeding device and a yarn brake having a braking band situated in a large diameter end section of a braking band carrier and arranged substantially coaxially relative to the axis of a storage body of the yarn feeding device.

The braking band carrier, e.g. a Kevlar-frustocone jacket, of a yarn feeding device known from U.S. Pat. No. 5,316,051 is held at its small diameter end outer side by means of an annular membrane simultaneously constituting the spring assembly. Said annular membrane is fixed in the support which can be adjusted along a bracket of the yarn feeding device and transmits the axial pre-loading force for pressing the braking band against the withdrawal rim. Yarn brakes, as schematically shown in 051 are designed in practice such that the annular membrane is replaced by several star-like arranged tension springs. During use significant fluctuation of the spring properties or spring forces occur among the parallel acting tension springs, resulting in a deterioration of the centering effect. Misalignments of the braking band carrier in relation to the longitudinal axis of the storage drum occur as well as an irregular braking effect of the braking band along the circumference of the withdrawal rim of the storage body. Due to a force deflection of almost 90° only a fraction of the spring force of the tension springs is used for generating the axial pre-loading force, so that an extremely high axial force has to be imparted on the tension springs.

WO 95/00431 discloses a yarn feeding device in which the braking band of the yarn brake is pulled by means of a conical, annular rubber membrane against the withdrawal rim. Said annular membrane is firmly secured at its large diameter end in a holder ring which is supported in the support via a Cardanic suspension having two Cardanic axes. Said Cardanic suspension is apt to assure an equilibrium position of the holder ring centered about the longitudinal axis of the storage body. However, since the spring assembly is integrated into the annular membrane, mispositionings of the braking band can occur leading to an irregular braking effect along the circumference of the withdrawal rim. One reason for this is that said annular membrane cannot not be manufactured homogeneously enough to transmit uniformly in the circumferential direction the infinite number of force components defining in total said axial pre-loading force. Furthermore, local ageing influences even can enforce the negative effect of such inhomogenities. Since the annular membrane simultaneously operates as a bending spring and a tension spring, a significant part of the introduced axial force is dissipated by interior deformation work so that a relatively high axial force is needed.

In both known yarn feeding devices, the yarn brake with its spring assembly and the support of said spring assembly result in a bulky design obstructing access to the storage body.

Further prior art is contained in DE 9406102 U and DE 4407958 A. Intermediate literature is constituted by DE 19542045 A.

It is a task of the invention to create a yarn feeding device as well as a yarn brake of the kind as disclosed in which, despite a compact design of the yarn brake, a proper centering of the braking band on the yarn storing body as well as braking conditions which are the uniform in circumferential direction can be achieved and wherein in the force transmission from the support into the braking band as little force as possible is wasted.

Said task is achieved by providing a universal joint having a joint center which coincides with the axis of the storage drum to allow axial displacements of the carrier and tilting thereof.

Thanks to its joint center positioned on the storage body longitudinal axis, the universal joint is apt to assure an optimal and positive centering of the braking band on the withdrawal rim, since no significant elasticity in the lateral direction exists. Furthermore, the universal joint does allow tilting motions of the baking band carrier in all directions. This assures a circumferentially uniform braking effect for the yarn between the braking band and the withdrawal rim. Even in case of a force transmission from the spring assembly into the universal joint, which force transmission is not uniform in relation to the storage body longitudinal axis, said universal joint—so to speak—first is concentrating all force components acting around the joint center in the joint center and distributes the resulting total force uniformly from the joint center to the braking band. Since due to the separation of the spring assembly from a centering task a direct axial spring force transmission can be carried out by the universal joint centered about the storage drum longitudinal axis and only small losses occur when transmitting the force. For the necessary axial pre-loading force a relatively weak spring assembly suffices due to low support forces. The universal joint and the spring assembly can be arranged within a relatively small space or can be arranged in the withdrawal direction of the yarn behind each other such that access to the drum is hardly obstructed. The mass of the moving components can be very small particularly if the universal joint is arranged between the braking band carrier and the support and is deviated by the spring assembly. This is advantageous for the response behaviour of the yarn brake. Since the universal joint is used for centering purposes and simultaneously the spring assembly is free from this task, both component groups can be customised optimally for their respective purposes, and the pre-loading force can be adjusted sensitively and precisely. The braking band carrier even remains positively centered in case of relative tilting motions and axial displacements and can even be rotated without deterioration of the centering effect.

The yarn brake can be an integrated part of a yarn feeding device or a selectively mountable structural unit for different types of yarn feeding devices or yarn feeding devices belonging to the same production series. The universal joint in which the braking band carrier can be displaced axially and can be tilted assures a mechanical and positive centering function without a significant lateral spring action. The braking band carrier nevertheless has its necessary degree of freedom for its working movements. Since tilting motions and axial displacement are happening within said universal joint which maintains the centering effect, a small moving mass can be realised and the motion resistance within said universal joint is low resulting in a sensitive response behaviour of the yarn brake. The sensitive response behaviour leads to the advantage that the yarn brake automatically adapts to very high yarn speeds or high frequencies of yarn tension variations and fulfills a so-called self-compensation as desirable for such yarn brakes in the broadest sense without interfering influences, i.e. the yarn brake automatically reduces its braking effect when the yarn tension increases due to yarn speed or acceleration.

The separation of the two tasks of positive centering and the transmission of the pre-loading force is useful, since the universal joint provides a constant positive and axial moveable centering of the braking band instead of an imprecise centering determined by spring action between the spring assembly and the braking band carrier, while the spring assembly only has to transmit the pressing force.

The universal joint can be a Cardanic joint or a ball joint. Even in the case of an axial displacement the easy moveability of the braking band carrier to all sides and relative to the spring assembly is assured. The transmission of the pressing force from the spring assembly into the braking band takes place without significant losses. A small tilting-motion range to all sides is sufficient. In all cases a smooth and easy tiltability and axial moveability of the braking band carrier is assured, even if the universal joint is operating in a small space (i.e. with a small action diameter). Said universal joint is axially guided at the support such that eccentric forces of the spring assembly cannot cause mispositioning of the braking band carrier.

A proper guidance of the yarn is achieved in the support and in the withdrawal channel. Accidentally occurring force components resulting from the deflection of the yarn in the withdrawal eyelet are backed up in the universal joint and cannot influence the centering of the braking band carrier. In connection therewith it can be expedient to secure the braking band carrier directly at the withdrawal eyelet. The withdrawal eyelet simultaneously forms a joint element of the universal joint. This results in a design having fewer parts. The support occupies only a fraction of the diameter of the storage body. Nevertheless, for the centering of the braking band carrier optimum lever arms are achievable.

In view of the operational safety of the yarn brake it might be advantageous to shield the universal joint. During operation of a yarn feeding device lint and other contaminants originating from the yarn material occur and have the tendency to deposit in a disturbing way in-between moveable components. This can be avoided by the shielding. The flexibility of the shielding assures the necessary moveability of the braking band carrier. It is of particular advantage to lift the yarn brake by means of the shielding which, with suction pressure actuation, is lifting the braking band carrier with its braking band from the withdrawal ring or at least is relieving the same so that threading of a yarn through the yarn brake can easily be carried out. The suction pressure actuation of the chamber can belong to a pneumatic threading system by means of which the yarn can be threaded automatically through the yarn feeding device and the yarn brake.

By providing two universal joint elements, a compact design is achieved with few parts only. During the working motions there are only very few moving masses since only one joint element moves in conjunction with the braking band carrier. The spring assembly is actuating the braking band carrier either directly or via a joint element holding the braking band carrier. The radial play can be small so that the centering function is not significantly influenced, but the tiltability of the braking band carrier to all sides remains possible, with a limited extent. There is a positive lost-motion connection of the joint elements realised which functions as the universal joint due to the radial play.

The braking band carrier can be directly held in the joint element by its conical end section. Expediently, the braking band carrier is only loosely trapped in the seat, e.g. in order to avoid falling out during transport. During operation the pre-loading force takes care of the positioning of the braking band carrier at said joint element. Said one joint element is apt to carry out the necessary tilting motions on said other joint element due to its concave curvature in the passage. Nevertheless, the one joint element is always centered on said other joint element. Alternatively it would be possible to form the passage essentially cylindrically and to provide a spherical surface on said other joint element.

The braking band carrier is inserted loosely into the seat in which it remains positioned due to the axial pre-loading force and one joint element is formed with an open seat and can be a unitary, lightweight plastic form part.

Alternatively, one joint element is defined by ring parts which, e.g., by means of a press fit or another sort of a connection, are secured to each other and define the seat between each other, in which seat the braking band carrier advantageously is positioned loosely. In case that said one joint element is injection formed at the braking band carrier directly, said structure even could be unitary. Two ring parts defining the seat lead to the advantage that the braking band carrier with its braking band occasionally can be replaced as a spare part.

Further the axial pre-loading force can be transmitted via said one joint element and the seat contact into the braking band carrier.

In one embodiment one joint element is not centered directly at the stationary support but on the other joint element which is secured in the sleeve body of the support.

Advantageously both joint elements of the universal joint are made from plastic material, at least in their mutual contact regions. The use of a self-lubricating plastic material may contribute to assure extremely low motional resistance.

BRIEF DESCRIPTION OF THE DRAWINGS

Embodiments of the object of the invention are described with reference to the drawings, in which.

DETAILED DESCRIPTION

Figure 1:
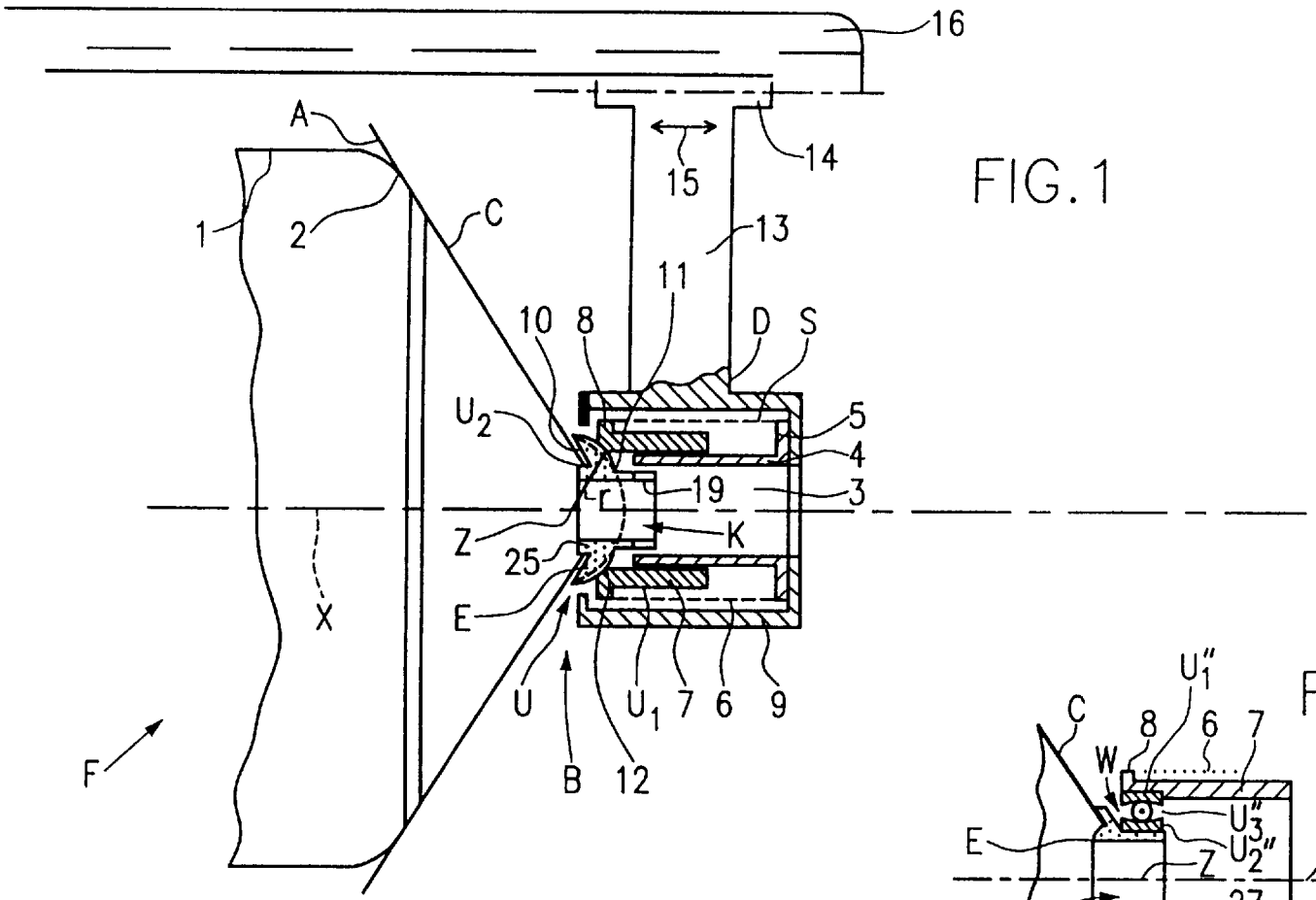
FIG. 1 illustrates a schematic longitudinal section of a part of a yarn feeding device including a yarn brake.

A drum shaped storage body 1 having a withdrawal rim 2 at its front side, a storage body axis X and a housing bracket 16 of a yarn feeding device F are indicated in FIG. 1. A yarn brake B co-operating with the storage body 1 is adjustably arranged at said housing bracket 16, e.g., the brake B is adjustable in the direction of a double arrow 15. The yarn feeding device F comprising said yarn brake B is particularly suitable for feeding weft yarns into projectile or rapier weaving machines.

The yarn brake B comprises a braking band A continuous in circumferential direction and in the shape of a frustocone jacket. It is secured in a large diameter end section of a braking band carrier C also having the shape of a frustocone jacket. Said braking band A is pressed against the withdrawal rim 2 by axial pre-loading force and with an orientation which is substantially coaxial to said axis X. The withdrawal rim 2 extends in the circumferential direction continuously and is in a longitudinal section of the storage body 1 rounded (line contact) or conical (surface contact). Said braking band A consists of wear resistant material, preferably of metal or a metal alloy like beryllium copper and has a thickness which allows same to easily deform. Said braking band carrier C is stiff in the axial direction, however, at least in the region of its large diameter end is radially easily deformable. It consists, e.g., of transparent plastic material or fiber-reinforced plastic material and is supported at its small diameter end region in a stationary support D which is suspended by means of a holding part 13, e.g. at a sleigh 14, in housing bracket 16.

A yarn (not shown) is stored on said storage body 1 in turns and is withdrawn overhead or around said withdrawal rim 2, is then deflected inwardly in a direction towards axis X and enters a central withdrawal eyelet E, preferably made of ceramic material, before it is withdrawn essentially axially through a withdrawal channel 3 passing said support D. In the mutual contact area between the braking band A and the withdrawal rim 2 a braking zone is provided which is continuous in circumferential direction and in which the yarn is braked during withdrawal.

Support D comprises a housing 9 the outer diameter of which can be much smaller than the outer diameter of storage body 1. Within housing 9 a sleeve part 4 is provided defining a cylindrical guiding surface oriented parallel to axis X. Sleeve part 4 has a counterfort 5 for a spring assembly S (which in the illustrated embodiment is a cylindrical coil compression spring 6). A further sleeve 7 is telescopically guided parallel to axis X on sleeve part 4. Said sleeve 7 has a flange 8 actuated by compression spring 6.

Within support D a universal joint U constituted by a ball joint K having its joint center Z situated on axis X. Universal joint U consists of at least two joint elements U1 and U2. Said sleeve 7 defines the first joint element U1 and has a front bearing surface 12 (e.g. a ball pan continuous in circumferential direction or consisting of discrete sections). Second joint element U2 is defined in the shown embodiment by withdrawal eyelet E provided at its rear side facing the bearing surface 12 with a counter bearing surface 11 (e.g. a spherical ball surface extending continuously in circumferential direction or being defined by discrete sections). The radius of the sphere is indicated by r. The joint center z is situated on axis X between withdrawal eyelet E and the front side of storage body 1. Within ball joint K bearing surface 12 or counter bearing surface 11 alone could be spherical in order to define the joint center Z. The respective other surface could then be formed by essentially spot-like contacting surfaces.

In this embodiment the braking band carrier C is secured to the withdrawal eyelet E, i.e. is inserted into a seat 10 of withdrawal eyelet E, and is optionally fixed there, e.g. by gluing or the like. The braking band carrier C instead could be inserted only loosely (rotatably) because it will be positioned by the axial pre-loading force per se.

In FIG. 1 the axial pre-loading force serving to press the braking band A against the withdrawal rim 2 is adjusted, e.g. by the axial position of the support D and is transmitted in a resilient fashion from the spring assembly S to the first joint element U1 centered on axis X. The braking band carrier C is centered on axis X within universal joint U. The pre-loading force is transmitted from bearing surface 12 to bearing surface 11, is concentrated at the joint center Z, and then is distributed to all sides uniformly into the braking band carrier C which presses the braking band A circumferentially uniformly against the withdrawal rim 2.

Figure 3:
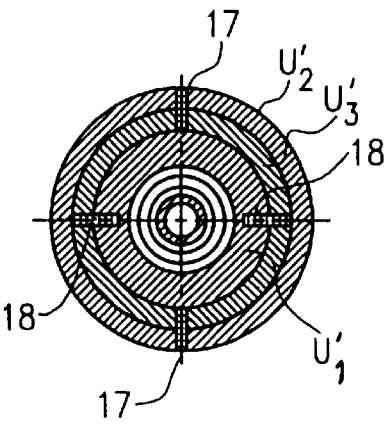
FIG. 3 is a radial section of the embodiment of FIG. 2.
Figure 2:
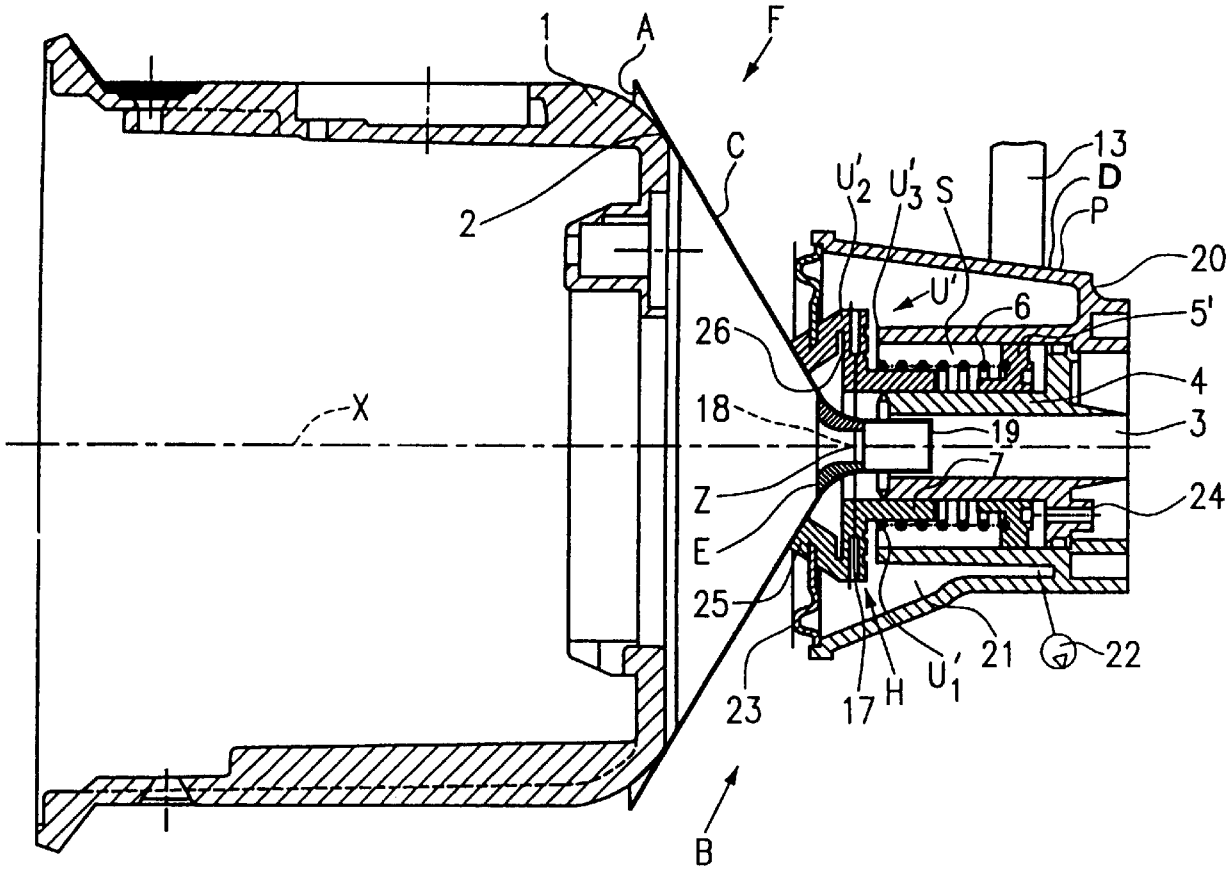
FIG. 2 is a longitudinal section of a further embodiment.

In FIG. 2 universal joint U' is defined in the interior space of support D as a Cardanic joint H comprising first, second and third joint elements U1', U2' and U3', wherein said first joint element U1' is formed by sleeve 7 analogous to FIG. 1. Sleeve 7 is guided on sleeve part 4 parallel to axis X and is axially actuated by the compression spring 6 of the spring assembly S. Sleeve 7 defines an inner ring which is coupled by means of a first Cardanic axis 18 (FIG. 3) defined by two axial shafts to an intermediate ring 26 defining the third joint element U3 such that said intermediate ring 26 is pivotable about the first Cardanic axis 18. The intermediate ring 26 is coupled by means of a second Cardanic axis 17 consisting of two axial shafts to an outer ring 25 forming said second joint element U2 and being connected to the outer side of braking band carrier C. The Cardanic axes 17, 18 are perpendicular to each other and intersect with axis X such that the joint center Z is defined on axis X and the braking band carrier C is apt to swivel to all sides about joint center Z and relative to support D. The spring counterfort 5' comprises in the shown embodiment an interior thread portion. It is secured in support D on sleeve part 4 having an outer threaded section. It can be adjusted in the axial direction by rotation of sleeve part 4 (by means of a turning knob (not shown) engaging at projection 24) in order to vary the pre-loading force of the spring assembly S, if desired. The spring counterfort 5' can be hindered against rotation but remains axially displaceable within support D. In addition or alternatively, and if desired, support D can be adjusted in the axial direction as in the FIG. 1 embodiment.

The universal joint U' is shielded from the exterior by means of a wall 23 formed as a flexible membrane secured in housing 20 of support D and at outer ring 25. Within housing 20 and behind wall 23 a chamber 21 is provided which can be connected to a suction pressure source 22 (indicated schematically) in order to displace the universal joint U' and the braking band carrier C by means of wall 23 in a direction counter to the pre-loading force of the spring assembly S (in FIG. 2 towards the right side) and to lift the braking band A from withdrawal rim 2 or to at least relieve its contact with withdrawal rim 2.

The braking band carrier C is provided with a tube-shaped prolongation 19 engaging with radial play into withdrawal channel 3. Withdrawal eyelet E as secured to braking band carrier C serves to deflect the withdrawn yarn into the withdrawal channel 3. The tube-shaped prolongation 19 could (as in FIG. 1) also be formed at the withdrawal eyelet E. The function of this embodiment corresponds to the function of the embodiment of FIG. 1.

Analogous to the embodiment according to FIG. 1, in the embodiment of in FIG. 2 the withdrawal eyelet E or a part holding the withdrawal eyelet E could be formed as joint element U2' in order to reduce the number of parts. Furthermore, it is possible to provide in FIG. 2 the Cardanic joint H inside of sleeve 7 and thus on a smaller action diameter. In FIG. 1 the ball joint K defining said universal joint U' also could be formed such that the ball pan could be provided in the second joint element U2' and could extend over the outer front end of sleeve 7 instead of engaging there inwardly.

In FIG. 2 the joint center Z is situated substantially in the theoretical cone apex of the braking band carrier C. The force transmission zone between the spring assembly S and the sleeve 7 is situated essentially with the same distance from axis X as the junction between the outer ring 25 and the braking band carrier C. Forces resulting from the deflection of the yarn in the withdrawal eyelet E are active in relation to axis X further inside than the force components of the spring assembly S at sleeve 7 or in universal joint U', respectively. The outer diameter of support D may be smaller by 20 to 70% than the outer diameter of the storage body 1. The cone apex angle of the braking band carrier C or braking band A, respectively, may vary depending on the purpose of the yarn brake or the yarn feeding device, respectively. The shielding of the universal joint U' by wall 23 analogous to FIG. 2 also can be used in the embodiment according to FIG. 1 or FIG. 5.

Figure 4:
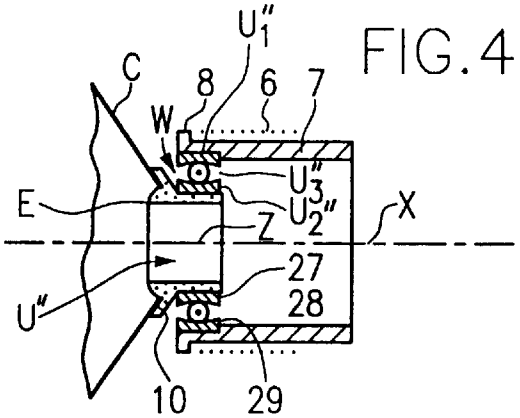
FIG. 4 is a section of yet a further embodiment.

In the embodiment according to FIG. 4 the axial displaceable universal joint U' is formed by a ball and roller bearing W the bearing races or bearing rings 27, 29 of which are provided with curved roller surfaces such that the bearing race or ring 29 by means of the rollers 28 is apt to fulfil tilting motions to all sides about joint center Z. The bearing races 27, 29 and the rollers 28 define joint elements U1", U2", U3" of said universal joint. The rollers can be balls, barrels or rollers with curved surfaces. The outer bearing race 29 is secured in axially guided sleeve 7 actuated by compression spring 6. The inner bearing race 27 holds withdrawal eyelet E at the seat of which the braking band carrier C is fixed. The ball and roller bearing alternatively could located at the outer side of sleeve 7. Furthermore, analogously to FIG. 2, the braking band carrier could be connected directly or by means of an intermediate part to one of the bearing races and could receive withdrawal eyelet E.

In all shown embodiment, particularly in the embodiments according to FIG. 4, the braking band carrier C with its braking band A may be rotated in support D and in relation to withdrawal rim 2 about the storage body axis X, either in seat 10 and/or in universal joint U".

Figure 5:
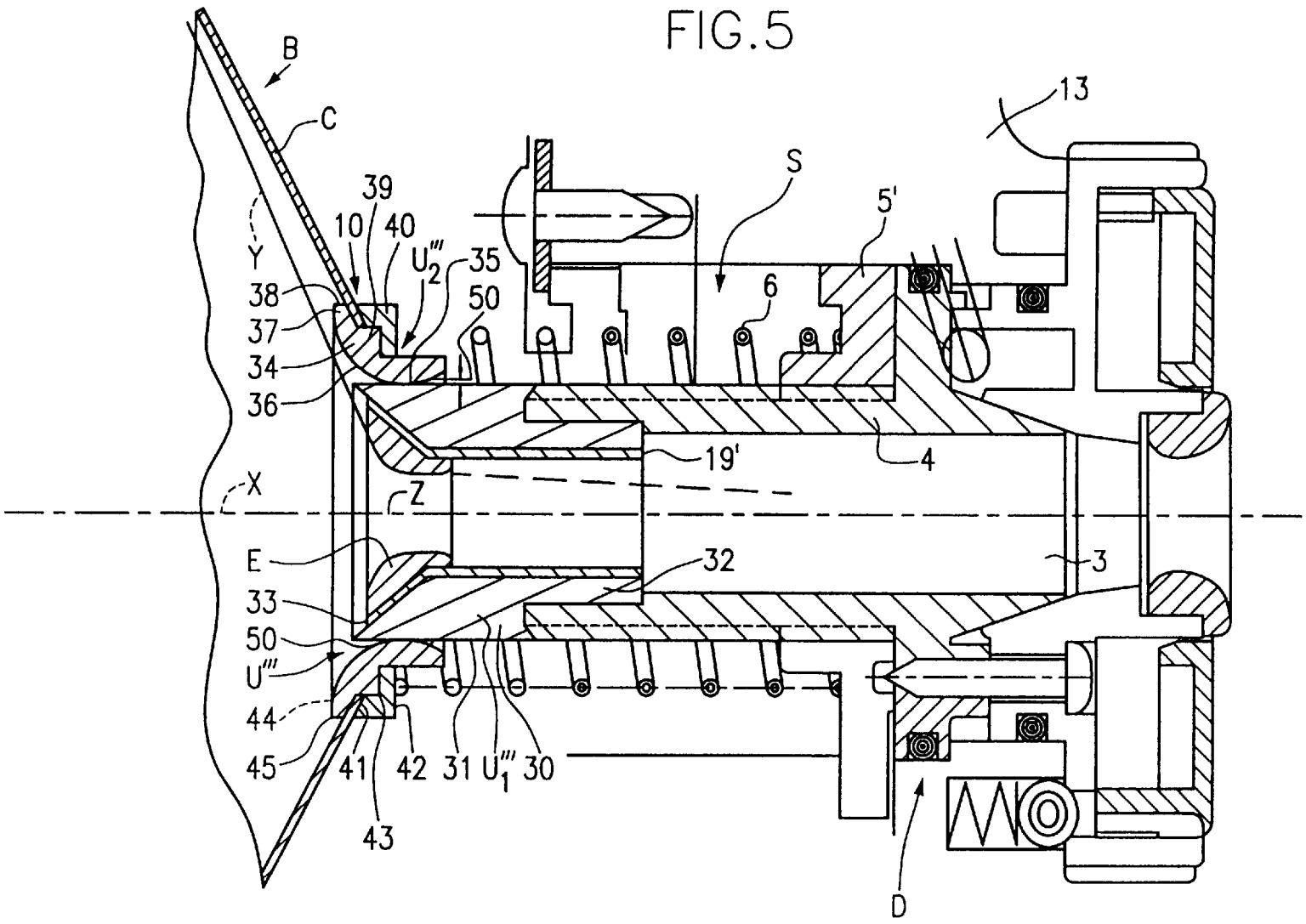
FIG. 5 is a still partial longitudinal section of a further embodiment of a yarn brake for a yarn feeding device.

FIG. 5 shows yarn brake B in a longitudinal section without the associated yarn feeding device. The universal joint U'" consists of two joint elements U1'" and U2'". The braking band carrier C of said yarn brake B is actuated by the axial pre-loading force originating from the compression spring 6 of the spring assembly S via one joint element U2'" or (not shown) directly. Compression spring 6 is supported at spring counterfort 5' which is guided for axial displacement in the stationary support D but is held non-rotatably and carried by sleeve part 4 of support D. Sleeve part 4 is stationary in the axial direction. Sleeve part 4 defining withdrawal channel 3 can be turned by means of a turning knob on the right side in order to vary the pre-tension of the compression spring 6 by means of axial displacements of spring counterfort 5'.

The other joint element U1'" for example is a sleeve body 30, e.g. made from plastic material, and is inserted into sleeve element 4 with end section 32 and is secured thereto. Sleeve body 30 has at least on a part of its longitudinal extension a cylindrical outer periphery 31 co-operating with said one joint element U2'" of universal joint U. A tubular projection 19' is held in sleeve body 30. Tubular projection 19' receives the stationary withdrawal eyelet E in a funnel-shaped, widened section 33. A yarn Y withdrawn from the storage body after passing the braking zone is running from the inner wall of braking band carrier C into the withdrawal eyelet E without contacting the components of the universal joint, behind or downstream of which the yarn Y is further conveyed through withdrawal channel 3.

Joint element U2'" in this embodiment consists of two ring parts 34 and 40 connected with each other such that they create a seat 10 for a small diameter conical end 45 of braking band carrier C. Ring parts 34, 40 are connected e.g. by a press fit, by gluing or by a screw or a bayonet connection. Ring part 34 has an inner passage 35 including an inner wall 36 the generatrix of which (in relation to axis X) is curved convexly. Said inner wall 36 circumscribes the cylindrical outer periphery 31 of joint element U1 with a small radial play 50, i.e. with a loose shift fit. The convex curvature of the inner wall 36 can be defined geometrically such that said one joint element U2'" can tilt (at least in a limited tilting range) to all sides and can be displaced axially on said other joint element U1'", and can, optionally, be easily rotated. Thanks to the radial play 50 the centering device of the braking band carrier C can be designed structurally simply in order to ensure the function of the universal joint U'". The joint center C can be situated essentially in axis X (or the theoretical prolongation of axis X of the storage body).

The outer edge region of ring element 34 has a circumferentially extending flange 37 forming a limitation 38 of seat 10. The other ring part 40 is seated on an essentially cylindrical boss 39 of ring part 34 defining by its outer edge section a further limitation 41 of seat 10. It may, e.g. at 43, be secured by a press fit. The rear side of the other ring part 40 defines a stop 42 for compression spring 6. Ring part 34 extends through said other ring part 40. The inner wall 36 ascends in FIG. 5 to the left and to the right in a rounded fashion. At least the contacting surfaces of both joint elements U1'", U2'" could be made from plastic material, preferably from a self-lubricating plastic material. If desired, both joint elements U1'", U2'" can be formed from plastic material, optionally, as injection molded plastic parts.

In FIG. 5 at 44 it is indicated by dotted lines that seat 10 of joint element U2'" could be open on the left side, i.e. that the circumferential flange of ring part 34 can be omitted. Solely by the axial pre-loading force and the reaction force originating from the storage body the braking band carrier C remains positioned in the open seat 10. Generally it is advantageous to design seat 10, even if it is limited at both sides by limitations 38 and 41, such that the small diameter conical end section 45 of braking band carrier C is held loosely such that its radial flexibility is not disturbed by a firm fixation in seat 10. Moreover, it is possible to form said joint element U2'" in an injection molding form directly to the braking band carrier C in order to form a unitary structure.

An inverse design of the universal joint U'" as shown in FIG. 5 can also be provided. Then the passage 35 could be essentially cylindrical while the other joint element U1'" has a spherical outer thickened ring. Finally it is possible to design ring part 34 with discrete fingers distributed in circumferential direction with interspaces, the inner sides of which define inner wall 36 of passage 35. By this measure the mass of said joint element U2'" could be further reduced. Since in the universal joint U'" in FIG. 5 the radial play 50 already allows the tilting and displacing function, both mutually centering round surfaces 31, 36 could even be cylindrical. Furthermore, the passage 35 could even include a sharp-edged inner annular edge.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a yarn brake for a yarn feeding device, said yarn brake defining an axis and including a frustoconical carrier which is axially stiff but radially flexible and a thin, wear-resistant, radially deformable, frustoconical and circumferentially continuous braking band supported in a large diameter end region of said carrier, said braking band being arranged substantially coaxially with the axis, a stationary support including a spring assembly which imparts an essentially axially directed force on said carrier, comprising the improvement wherein said support carries a universal joint which centers said carrier relative to the axis and acts between said spring assembly and said carrier to permit both axial displacement of said carrier and tilting of said carrier in any direction relative to the axis.

2. In a yarn feeding device including a storage body defining an axis and a circumferentially continuous withdrawal rim, a yarn brake comprising a frustoconical carrier which is axially stiff but radially deformable and a thin, wear-resistant, radially deformable, frustoconical and circumferentially continuous braking band supported in a large diameter end region of said carrier, said braking band being arranged substantially coaxially with the axis and having an inwardly facing side held at said withdrawal rim, a stationary support including a spring assembly which imparts an essentially axially directed force on said carrier, comprising the improvement wherein a universal joint including at least two mechanically and positively cooperating joint elements is provided between said spring assembly and said carrier, said universal joint defining a joint center which coincides with the axis of said storage body.

3. The yarn feeding device of claim 2 wherein said universal joint is connected to said braking band and acts as a centering device for centering said braking band relative to the axis of said storage body, said universal joint being axially displaceable within said support and being axially actuated by said spring assembly.

4. The yarn feeding device of claim 2 wherein said universal joint comprises three mechanically and positively cooperating joint elements which together form a Cardanic joint defining a pair of Cardanic axes oriented substantially perpendicular relative to one another and each intersecting the axis of said storage body, a first of said joint elements being defined as an inner ring which is coupled by a pair of coaxially aligned shaft members each disposed along one of the Cardanic axes to a second of said joint elements defined by an intermediate ring, said intermediate ring being pivotable about said one Cardanic axis and coupled by a pair of coaxially aligned shaft members each disposed along the other Cardanic axis to a third of said joint members defined by an outer ring, said outer ring being connected to an outwardly facing side of said braking band and being pivotable about said other Cardanic axis to permit tilting movement of said braking band relative to the axis of said storage body.

5. The yarn feeding device of claim 2 wherein said two joint elements together define a ball joint.

6. The yarn feeding device of claim 5 wherein said two joint elements define thereon respective cooperative bearing surfaces, a first of said bearing surfaces having a generally concave configuration and being centered relative to the axis of said storage body, and a second of said bearing surfaces having a generally hemispherical shape and being supported at said first bearing surface for movement about the joint center.

7. The yarn feeding device of claim 6 wherein said joint element including said second bearing surface defines a yarn withdrawal eyelet disposed in and fixed to a small diameter end region of said braking band.

8. The yarn feeding device of claim 2 wherein said yarn brake further includes a flexible annular shield connected between said universal joint and said support, said support and said shield together defining a generally hollow interior chamber in which said universal joint is disposed, said chamber communicating with a suction source which negatively pressurizes said chamber to effectively lift said braking band from said withdrawal rim through said universal joint and said shield.

9. In a yarn feeding device including a storage body defining an axis and a circumferentially continuous withdrawal rim, a yarn brake comprising a frustoconical carrier which is axially stiff but radially deformable and a thin, wear-resistant, radially deformable, frustoconical and circumferentially continuous braking band supported in a large diameter end region of said carrier, said braking band being arranged substantially coaxially with the axis and having an inwardly facing side held at said withdrawal rim, a stationary support including a spring assembly which imparts an essentially axially directed force on said carrier, comprising the improvement wherein said support carries a universal joint which centers said carrier relative to the axis and acts between said spring assembly and said carrier to permit both axial displacement of said carrier and tilting motions thereof in any direction relative to the axis.

10. The yarn feeding device of claim 9 wherein said universal joint includes a pair of joint elements, one of said joint elements being connected to said carrier and the other said joint element being connected to said support, said one joint element being axially movable and tiltable in any angular direction relative to the axis, said joint elements being generally concentrically oriented relative to one another and defining a slight radial clearance therebetween to permit rotation of said one joint element about the axis relative to said other joint element, and said spring assembly being disposed to exert an axial force on said carrier either through said one joint element or directly.

11. The yarn feeding device of claim 10 wherein said one joint element has a generally conical end section which defines a seat engaged by a small diameter end region of said carrier, said one joint element having an annular shape and an inner wall with a convex curvature which defines a generally funnel-shaped and generally axially extending passage, said other joint element being disposed within said passage and defining a generally cylindrical outer periphery with which said inner wall is slidably engageable.

12. The yarn feeder of claim 11 wherein said seat opens radially outwardly and towards said carrier, and said one joint element comprising a monolithic, one-piece component.

13. The yarn feeder of claim 11 wherein said one joint element includes a pair of mutually engaging ring parts between which said seat is defined.

14. The yarn feeder of claim 13 wherein said ring parts are generally concentrically oriented inner and outer ring parts, said inner ring part defining said passage therein and a first wall disposed radially outwardly of said passage, said outer ring part surrounding said inner ring part and defining a second wall disposed in opposed but spaced-apart relation with said first wall such that said seat is defined therebetween, said inner ring part further defining a stop surface which faces away from said second wall and which is abutted by a terminal end of said spring assembly.

15. The yarn feeder of claim 10 wherein said support includes a sleeve body which projects generally axially towards said other joint element, said other joint element comprising a sleeve-shaped member having a terminal end which is engaged within a terminal end of said sleeve body and fixed thereto.

16. A yarn feeding device comprising:

a storage body defining an axis and a withdrawal area extending circumferentially about the axis;

a generally frustoconical carrier defining an inner end region positioned adjacent the axis and an outer end region having a greater diameter than said inner end region and being positioned adjacent said withdrawal area;

a generally frustoconical braking band supported on said outer end region of said carrier in opposed relation with said withdrawal area;

a support structure disposed adjacent said withdrawal area and including a biasing member which exerts a generally axially directed force on said carrier to urge same towards said withdrawal area; and a first joint element associated with said carrier and a second joint element supported by said support structure, said first and second joint elements cooperating with one another to define a universal joint which acts between said biasing member and said carrier, said first and second joint elements including respective opposed bearing surfaces which are configured for cooperative engagement with one another to permit angular movement of said carrier in any direction relative to the axis such that the axially directed force of said biasing member is distributed in a substantially uniform manner to said braking band.

17. The yarn feeder of claim 16 wherein said bearing surface of one of said first and second joint elements is hemispherical in shape and said bearing surface of the other said first and second joint element is a concave in shape, said biasing member being disposed to urge said bearing surfaces into direct sliding contact with one another to permit angular displacement of said carrier such that a central axis of said carrier is oriented transversely relative to the storage body axis.

18. The yarn feeder of claim 17 wherein said one joint element is said first joint element, said first joint element being connected to said inner end region of said carrier and having an annular shape to permit the passage of yarn from said withdrawal area therethrough, said bearing surface of said first joint element defining an outer surface thereof which faces away from said withdrawal area, and said second joint element comprises a sleeve which is axially movably disposed within said support structure, said bearing surface of said second joint element defining an annular end surface thereof disposed in opposed and contacting relation with said bearing surface of said first joint element, and said biasing member being disposed to act directly on said sleeve such that the axially directed force thereof is transmitted to said carrier through said first and second joint elements.

19. The yarn feeder of claim 16 wherein said first and second joint elements each mount thereon respective rings each defining thereon a respective said bearing surface which has a curved shape, said bearing surfaces being disposed in opposed relation with one another and being spaced apart by a roller element which is sandwiched therebetween to permit angular displacement of said carrier such that a central axis thereof is oriented transversely relative to the storage body axis.

20. The yarn feeder of claim 19 wherein said first joint element has an annular shape to permit passage of yarn from said withdrawal eyelet therethrough and mounts the respective said ring on an outer periphery thereof, said second joint element including a sleeve which surrounds at least part of said first joint element and mounts the respective said ring on an inner periphery thereof such that said rings are arranged generally concentrically with one another, and said biasing member acting directly on said sleeve such that the axially directed force thereof is transmitted to said carrier through said first and second joint elements.

21. The yarn feeder of claim 16 wherein said bearing surface of one of said first and second joint elements has a generally cylindrical shape and said bearing surface of the other said first and second joint element has a convex shape, said biasing member being disposed to urge said bearing surfaces into direct contact with one another to permit angular displacement of said carrier such that a central axis thereof is oriented transversely relative to the storage body axis.

22. The yarn feeder of claim 21 wherein said first joint element is connected to said inner end region of said carrier and has an annular shape with an inner periphery defined by said convex bearing surface, said second joint element including a sleeve which permits passage of yarn from said withdrawal area therethrough, said sleeve being surrounded by said first joint element and defining said cylindrical bearing surface on an outer periphery thereof, said sleeve being stationarily disposed within said support structure and mounting thereon a stop which is axially adjustable, said biasing member being disposed between said stop and said first joint element such that the axially directed force thereof is transmitted to said carrier through said first and second joint elements.

23. A yarn feeding device comprising:

a storage drum defining an axis and a yarn withdrawal area at one end thereof which extends circumferentially about the axis;

a generally frustoconical carrier ring defining an inner end region positioned adjacent the axis and an outer end region positioned adjacent said withdrawal area;

a generally frustoconical braking band supported by said outer end region of said carrier ring such that an inner annular surface of said braking band is disposed in opposed relation with said withdrawal area;

a support structure disposed adjacent said withdrawal area and mounting thereon a biasing member disposed to exert a generally axially directed force on said carrier ring to urge said braking band against said withdrawal area; and a universal joint interposed between said biasing member and said carrier ring to transmit the axially directed force of said biasing member thereto, said universal joint defining first and second axes which are perpendicular to one another and intersect the axis of said storage drum, said joint including a pair of ring-shaped joint elements which are each pivotably movable about one of the first and second axes to permit tilting movement of said carrier ring in any direction relative to the storage drum axis.

24. The yarn feeding device of claim 23 wherein said universal joint includes an inner ring associated with said support structure and centered relative to the storage drum axis, one said ring-shaped joint element includes an intermediate ring connected to said inner ring for pivoting movement about the first axis, and the other said joint element includes an outer ring associated with said inner end region of said carrier ring and connected to said intermediate ring for pivoting movement about the second axis.

* * * * *